United States Patent [19]

Tsuzuki et al.

[11] 4,243,490

[45] Jan. 6, 1981

[54] RADIAL CUTTER TYPE CLEANING APPARATUS FOR COKE OVEN DOOR BOTTOM SURFACE

[75] Inventors: Akira Tsuzuki, Yokohama; Atsushi Miura, Chiba, both of Japan

[73] Assignee: Koritsu Kikai Kogyo Company Limited, Tokyo, Japan

[21] Appl. No.: 60,458

[22] Filed: Jul. 25, 1979

[51] Int. Cl.[3] ..... C10B 43/04

[52] U.S. Cl. ..... 202/241; 15/93 A

[58] Field of Search ..... 202/241; 15/93 R, 93 A; 201/2

[56] References Cited

U.S. PATENT DOCUMENTS

| | | | |
|---|---|---|---|
| 3,822,191 | 7/1974 | Konno | 202/241 |
| 3,990,948 | 11/1976 | Lindgren | 202/241 |
| 4,097,304 | 6/1978 | Taylor | 202/241 X |
| 4,135,987 | 1/1979 | Jorzenink et al. | 202/241 |
| 4,165,261 | 8/1979 | Henstra et al. | 202/241 |

FOREIGN PATENT DOCUMENTS

| | | | |
|---|---|---|---|
| 2384837 | 11/1978 | France | 202/241 |

*Primary Examiner*—Frank W. Lutter
*Assistant Examiner*—Roger F. Phillips
*Attorney, Agent, or Firm*—Wills, Green & Mueth

[57] ABSTRACT

Any type of door bottom surface can be completely cleaned by the cleaning apparatus of this invention which comprises a carriage which is driven along a pair of horizontal platforms per se forming therebetween a passage for the carriage, a pair of supporting plates pivotably mounted on the carriage, a radial cutter device rotatably held by the supporting plates at the latter's frontward ends, said radial cutter device being cylindrical and having thereon several cutting blades radially extending and longitudinally aligned in parallel, a pair of coil springs charged between said front ends of the supporting plates and front portions of the carriage, and drive means for moving the radial cutter device and the carriage itself.

6 Claims, 5 Drawing Figures

RADIAL CUTTER TYPE CLEANING APPARATUS FOR COKE OVEN DOOR BOTTOM SURFACE

BACKGROUND OF THE INVENTION

This invention relates to a radial cutter type cleaner to be used for cleaning the bottom surface of a coke oven door. Tar and the like which are produced in the coke oven chamber stick on the coke oven doors which are removably put on the door openings of both the pusher side and quencher side of the coke oven chamber, and thus are apt to hamper sealing efficiency of the door and both door removal and reinstallation operations. Therefore, frequent cleaning operations of the door have been required to scrape off the tar and the like so stuck on the door. However, on the bottom surface, or the brick holding frame of the door, there are gathered much tars and the like including those dropped from side surfaces and thus there are formed thick, persistent tar layer. Conventional plate type or disc wheel type cleaners are apt to ride and pass on such thick, persistent tar layer without scraping them.

Further, while the height of the door bottom surface or brick holding frame to be cleaned varys with types of the door, conventional clearners have had insufficient height adjustment means. Thus, in case where the bottom surface of the brick holding frame to be cleaned is situated fairly high, the scraper cannot or insufficiently reach the bottom surface. This invention is directed to provide a new, efficient cleaning apparatus particularly for scraping the door bottom surface without the abovementioned defects.

BRIEF SUMMARY OF THE INVENTION

The door bottom surface cleaning apparatus of this invention characteristically comprises a carriage which is driven along a pair of horizontal platforms per se forming therebetween a passage for the carriage, a pair of supporting plates pivotaly mounted on the carriage, a radical cutter device rotatably held by the supporting plates at the latter's frontward ends, said radial cutter device being cylindrical and having thereon several cutting blades radially extending and longitudinally aligned in parallel, a pair of coil springs charged between said front ends of the supporting plates and front portions of the carriage, and drive means for moving the radial cutter device and the carriage itself. The radial cutter device is forcibly lifted by pressure of the coil springs.

Constructed as above, the door bottom surface cleaning apparatus of this invention can completely scrape off all the tar and the like persistently stuck on the door bottom surface, since the horizontal surface is powerfully scraped by radial cutter rotating perpendicularly thereto. Further, the cleaning apparatus of this invention can be used for various types of doors having various height of bottom surface because the radial cutter device is previously set at a position somewhat high and contacting pressure between the bottom surface and the cutter can be reduced by the coil springs.

DETAILED DESCRIPTION OF THE INVENTION

Figures 1, 2:
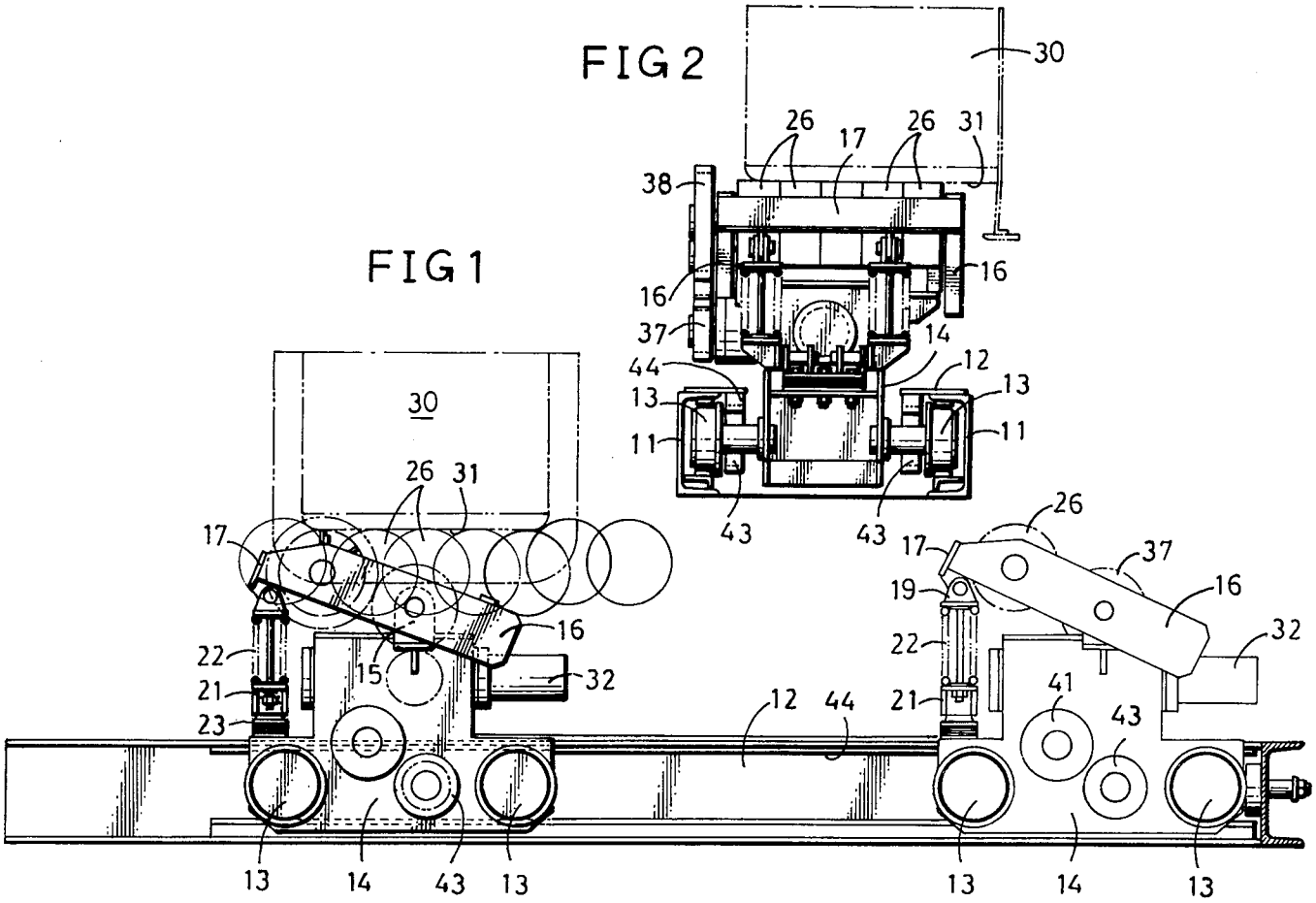
FIG. 1 is a side elevational view of a door cleaning apparatus in accordance with the invention.
FIG. 2 is a side elevational view of the door cleaning apparatus.
Figures 3, 4, 5:
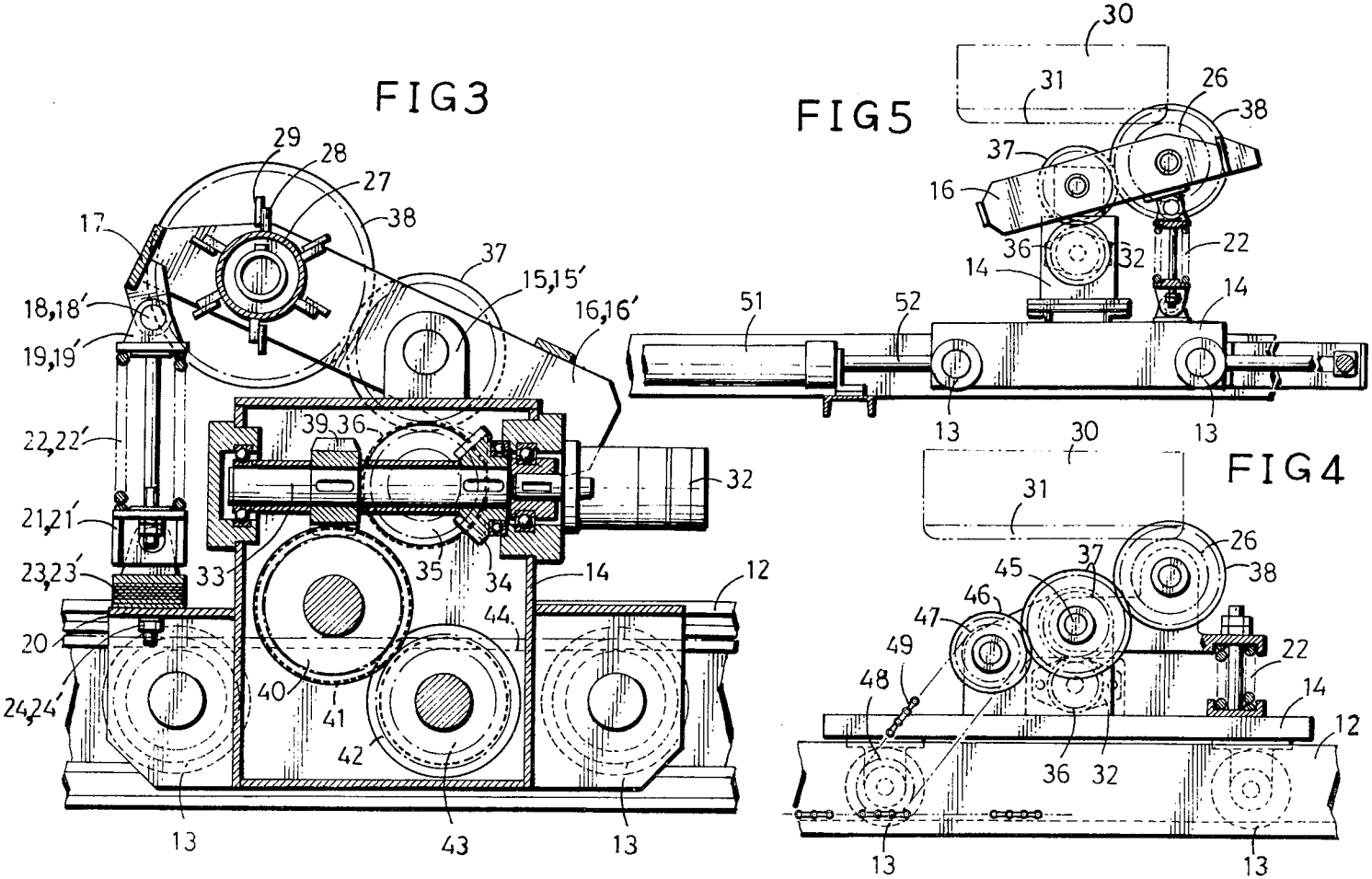
FIG. 3 is an enlarged view of the door cleaning apparatus shown in FIG. 1 illustrating drive means for both the radial cutter device thereof and a carriage.
FIG. 4 is a front elevational view of a modified drive means.
FIG. 5 is a front elevational view of another modified drive means.

Referring to the drawings, more particularly to FIG. 2, a pair of channels 11, 11' are fixed to each bottom surface of a pair of horizontal platform 12. The platforms 12 are placed in parallel to form a passage therebetween for a carriage 14 which is movable to and from by means of wheels 13 thereof. As shown in FIGS. 1 and 3, the carriage 14 has a pair of fitting means 15, 15' fixed on the upper plate thereof and extending upward at places somewhat rear from the center.

The fitting members 15, 15' are rotatably pivoted thereto with a pair of elongated supporting plates 16, 16' respectively. The supporting plates 16, 16' are longer than the upper plates of the carriage 14. Both front ends of the supporting plates 16, 16' are associated with connecting plates 17. As shown in FIGS. 2 and 3, beneath both somewhat sideward end portions of the connecting plates 17 are fixed a pair of upper spring shoe members 19, 19' which have transverse pivot rods 18, 18' therebetween.

On a plate 20 extending outwardly from the front center of the carriage 14, there are fixed lower spring shoe members 21, 21' in opposition to the upper shoe members 19, 19'. A pair of coil springs 22, 22' are charged between the upper and lower spring shoe members 19, 19' and 21, 21' respectively in order to forcibly lift the front ends of the supporting plates 16, 16'. A plurality of liners or shims 23, 23' are inserted between the lower spring shoe members 21, 21' and the plate 20. By adding or reducing said liners 23, 23', height of the front ends of the supporting plates 16, 16' can be adjusted. In FIGS. 1 and 3, reference numbers 24, 24' indicate spring pressure adjustment screws for the coil springs 22, 22'.

A rotation shaft 25 is installed over both frontward ends of the supporting plates 16, 16' and several blocks of cutter devices 26 are fitted thereon side by side. (In FIG. 2, five blocks are shown). Each block of radial cutter devices 26 comprises cylindrical sleeve 27 to be fitted on the rotation shaft 25, plural base plates 28 (in FIG. 3, six plates are shown) secured radially to and longitudinally over whole length of the peripheral surface of the sleeve 27, cutter blades 29 each replaceably bolted to the base plate 28 with their outer ends shifted out.

The radial cutter devices 26 are previously set in such position well higher than standard height of the bottom surface 31 of brick holding frame of a door 30 to be cleaned. For cleaning the door 30, it is brought to the middle portion of the platform 12 and the carriage 14 is driven while rotating the radial cutter devices 26. When the carriage 14 is driven to the middle of the platform 12 and the radial cutter 26 abut against one end corner position of the bottom surface 31, the radial cutter devices are driven beneath the bottom surface 31 while pressing down the coil springs 22, 22'. By so driven while rotating radially to the bottom surface 31, the radial cutter devices 26 can effectively scrape tar and the like stuck on the bottom surface 31. Referring now to FIG. 3, there is illustrated an example of a drive means for both the radial cutter devices 26 and the carriage 14.

The carriage 14 has a hydraulic motor 32 fixed on the rear wall thereof, a shaft 33 of the hydraulic motor laterally extends through the carriage 14 to the front wall thereof and a bevel gear 34 is secured on the shaft 33 at a position near to the rear wall. Another bevel gear 35 is provided to engage with said bevel gear 34. A transmittion gear 36 associated with the bevel gear 35 engages with a second transmission gear 37 which engages in turn with a third transmission gear 38. The radial cutter devices 26 are driven by the third transmission gear 38.

Likewise, on the shaft 33 is secured a worm 39 at a center portion somewhat near the front end thereof. The worm 39 engages with a worm gear 40 which in turn engages with gears 41, 42. A rack gear 43 associated with the gear 42 engages with a rack rail 44 fitted beneath the horizontal platform 12. Thus, the carriage 14 can be driven by the rotation of rack gear 43. The hydraulic motor is so designed that when the carriage 14 reaches to the end of frontward movement rotation of the motor is reversed automatically. Reversed rotation of the motor results in backward movement of the carriage 14 and also reversed rotation of the radial cutter devices. The radial cutter devices rotate in such direction as opposite to that of the carriage 14 since it is driven by one more transmission gear than the carriage. Thus, the power for scraping the bottom surface of the door is largely enforced.

In FIG. 4, a second example of the drive means for the carriage is illustrated. A gear 46 enages with the gear 37 which is fitted on a shaft 45 which drives the radial cutter device. It engages through an intermediate sprocket wheel 47 with a sprocket wheel 48 fitted on the carriage wheel shaft by chains 49. A third example of the drive means for moving the carriage 14 is shown in FIG. 5. In this case, the carriage 14 is driven to and from by means of a hydraulic cylinder 52 and a rod 53 thereof. In any case, the radial cutter devices forcibly lifted by the pressure of coil springs.

What is claimed is:

1. A door bottom surface cleaning apparatus comprising in combination:

a pair of parallel horizontal members;

a carriage actuable along said horizontal members and having front and rear portions;

a pair of rigid supporting plates having first and second ends, said plates linked at said first ends by a connecting plate and mounted at locations spaced from said first ends to the rear portion of the carriage for pivotal movement about a first axis transverse to the direction of carriage travel;

a radial cutter device mounted to the supporting plates adjacent said first ends for rotation about a second axis parallel to said first axis, said radial cutter device being cylindrical and having thereon several cutting blades extending radially therefrom and aligned parallel to said second axis;

a pair of axially compressible coil spring devices having upper and lower ends, said devices pivotally mounted at said lower ends to the front portion of the carriage and at said upper ends to the first ends of the supporting plates, yieldingly urging the radial cutter device upwardly relative to the carriage; and drive means for rotating the radial cutter device and moving the carriage along said horizontal members.

2. A door bottom surface cleaning apparatus as recited in claim 1, wherein said drive means includes a hydraulic motor driving the radial cutter and the carriage through transmission gears and rack gearing respectively.

3. A door bottom surface cleaning apparatus as recited in claim 1, wherein the carriage is mounted on wheels actuable by said drive means to drive the carriage.

4. A door bottom surface cleaning apparatus as recited in claim 1, wherein the carriage is driven by a hydraulic cylinder and associated rod.

5. A door bottom surface cleaning apparatus as recited in claim 1, wherein the radial cutter is rotated in a direction counter to the direction of rotation of the carriage wheels.

6. A door bottom surface cleaning apparatus as recited in claim 1, wherein the radial cutter blades are replaceable.

* * * * *